US009711080B2

(12) United States Patent
Kang et al.

(10) Patent No.: US 9,711,080 B2
(45) Date of Patent: Jul. 18, 2017

(54) TIMING CONTROLLER, DRIVING METHOD THEREOF, AND DISPLAY DEVICE USING THE SAME

(71) Applicant: LG Display Co., Ltd., Seoul (KR)

(72) Inventors: Yoo Jin Kang, Paju-si (KR); Jun Woo Jang, Seoul (KR); Woong Jin Seo, Daegu (KR)

(73) Assignee: LG Display Co., Ltd., Seoul (KR)

( * ) Notice: Subject to any disclaimer, the term of this patent is extended or adjusted under 35 U.S.C. 154(b) by 176 days.

(21) Appl. No.: 14/073,111

(22) Filed: Nov. 6, 2013

(65) Prior Publication Data

US 2014/0146066 A1 May 29, 2014

(30) Foreign Application Priority Data

Nov. 27, 2012 (KR) ..... 10-2012-0135464

(51) Int. Cl.
*G09G 3/3225* (2016.01)

(52) U.S. Cl.
CPC ..... *G09G 3/3225* (2013.01); *G09G 2320/046* (2013.01); *G09G 2320/0626* (2013.01); *G09G 2320/0653* (2013.01); *G09G 2320/103* (2013.01); *G09G 2360/16* (2013.01)

(58) Field of Classification Search
CPC ..... G09G 3/2003
See application file for complete search history.

(56) References Cited

U.S. PATENT DOCUMENTS

2002/0044607 A1* 4/2002 Koga ..... G06T 7/2053 375/240.16
2006/0176251 A1 8/2006 Park et al.
2008/0100645 A1* 5/2008 Nitta ..... 345/690
2008/0284702 A1 11/2008 Shidara et al.
2010/0060554 A1* 3/2010 Koh ..... G09G 3/3225 345/77
2010/0165445 A1* 7/2010 Lee ..... G02F 1/167 359/296
2010/0321581 A1 12/2010 Iwakura et al.
2013/0063500 A1* 3/2013 Oka et al. ..... 345/690
2014/0015870 A1* 1/2014 Takahashi et al. ..... 345/691

FOREIGN PATENT DOCUMENTS

CN 101778230 A 7/2010
KR 10-2012-0010790 A 2/2012

* cited by examiner

*Primary Examiner* — Kee M Tung
*Assistant Examiner* — Grace Q Li
(74) *Attorney, Agent, or Firm* — Fenwick & West LLP

(57) ABSTRACT

Disclosed are a timing controller, a driving method thereof, and a display device using the same. The timing controller includes a memory configured to sequentially store input video data of respective frames, a determiner configured to compare the input video data of respective frames to determine whether a scene is changed, and a converter configured to, when it is determined by the determiner that the scene is changed, in the same scene section until the scene is changed and then changed to another scene, reduce luminance of the input video data included in the scene section, and output image data with reduced luminance.

20 Claims, 9 Drawing Sheets

(a) Total average luminance : 0.50

(b) Total average luminance : 0.48

TIMING CONTROLLER, DRIVING METHOD THEREOF, AND DISPLAY DEVICE USING THE SAME

CROSS-REFERENCE TO RELATED APPLICATIONS

This application claims the benefit of the Korean Patent Application No. 10-2012-0135464 filed on Nov. 27, 2012, which is hereby incorporated by reference as if fully set forth herein.

BACKGROUND

Field of the Invention

The present invention relates to a display device, and more particularly, to a timing controller, a driving method thereof, and a display device using the same, which can solve an image-sticking problem.

Discussion of the Related Art

Flat panel display (FPD) devices are applied to various electronic devices such as portable phones, tablet personal computers (PCs), notebook computers, etc. The FPD devices include liquid crystal display (LCD) devices, plasma display panels (PDPs), organic light-emitting display devices, etc. Recently, electrophoretic display (EPD) devices are widely used as the FPD devices.

Among such display devices, organic light-emitting display devices use a plurality of self-emitting elements that self-emit light, and thus have a fast response time, a high emission efficiency, a high brightness, and a wide viewing angle.

FIG. 1 is a graph showing an example of a method in which luminance is reduced with time in a related art organic light emitting display device, FIG. 2 is a flowchart illustrating a related art method of reducing luminance with time, and FIG. 3 are exemplary diagrams illustrating images having the same total average luminance when applying the related art method of reducing luminance with time.

Each of a plurality of pixels of a general organic light emitting display device includes an organic light emitting diode (OLED) and at least two or more transistors (T1, T2) that are connected to a data line (DL) and a gate line (GL) to control the organic light emitting diode (OLED).

The organic light emitting display device uses the organic light emitting diode (OLED) that is a self-emitting element, and thus has higher power consumption than other types of display devices.

The organic light emitting display device, as shown in FIGS. 1 and 2, uses a method of reducing luminance with time, for decreasing power consumption.

The method of reducing luminance with time gradually reduces luminance of a still image with time, and FIG. 1 shows an example that reduces the luminance of the still image with time.

The related art method of reducing luminance with time, as illustrated in FIG. 2, inputs an image in operation S10, and determines whether the input image is a still image in operation S20. When it is determined that the input image is not a still image, the related art method outputs the original image as-is in operation S40, and when it is determined that the input image is the still image, the related art method reduces luminance with time in operation S30, and outputs the image with reduced luminance in operation S40.

As described above, technology for temporally reducing luminance of a still image should preferentially perform an operation that determines whether a currently output image is a still image.

Generally, when frames having the same average grayscale level (APL) of an image are continuously input for a certain time or more, a current image is determined as a still image.

However, a method that determines whether a current image is a still image by using an average grayscale level (APL) of an image has a limitation.

For example, in FIG. 3, two images (frames) having the same average grayscale level (APL) are illustrated. When intuitively seen, an image illustrated in a portion (a) of FIG. 3 is not similar to an image illustrated in a portion (b) of FIG. 3.

However, the related art technology determines whether a current image is a still image by using an average grayscale level (APL), and thus, although two images of FIG. 3 are not still images, the related art technology determines the two images of FIG. 3 as still images and reduces luminance. That is, the related art technology reduces luminance of an image that is not a still image.

Moreover, since the related art technology reduces luminance of only a still image, the related art technology cannot greatly contribute to decrease power consumption of the organic light emitting display device. This is because cases of continuously viewing a still image are very rare under a viewing environment of general display devices.

The related art technology has the following problems.

First, since the related art technology determines whether a current image is a still image by using an average grayscale level (APL) and then reduces luminance of the still image, luminance of an image that is determined as not being the still image can be reduced.

Second, since the related art technology reduces luminance of only a still image, a reduction efficiency of power consumption is not high under a viewing environment of general display devices.

SUMMARY

Accordingly, the present invention is directed to providing a timing controller, a driving method thereof, and a display device using the same that substantially obviates one or more problems due to limitations and disadvantages of the related art.

An aspect of the present invention is directed to providing a timing controller, a driving method thereof, and a display device using the same, which can continuously reduce luminance of input video data to the maximum reduction amount in the same scene section until a scene is changed and then changed to another scene.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, there is provided a timing controller including: a memory configured to sequentially store input video data of respective frames; a determiner configured to compare the input video data of respective frames to determine whether a scene is changed; and a converter configured to, when it is determined by the determiner that the scene is changed, in the same scene section until the scene is changed and then changed to another scene, reduce luminance of the input video data included in the scene section, and output image data with reduced luminance.

In another aspect of the present invention, there is provided a method of driving a timing controller including: sequentially storing input video data of respective frames; comparing the input video data of respective frames to determine whether a scene is changed; and when it is determined that the scene is changed, in the same scene section until the scene is changed and then changed to another scene, reducing luminance of the input video data included in the scene section.

In another aspect of the present invention, there is provided a display device including: a panel configured to include a plurality of pixels respectively formed in a plurality of areas defined by intersections between a plurality of gate lines and a plurality of data lines; the timing controller; a data driver configured to convert image data, transferred from the timing controller, into analog image signals and respectively output the analog image signals to the plurality of data lines; and a gate driver configured to output a scan signal to the plurality of gate lines at every one horizontal period in which the image signals are output, according to a control signal transferred from the timing controller.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the exemplary embodiments of the present invention, examples of which are illustrated in the accompanying drawings. Wherever possible, the same reference numbers will be used throughout the drawings to refer to the same or like parts.

Hereinafter, embodiments of the present invention will be described in detail with reference to the accompanying drawings.

Figure 1:
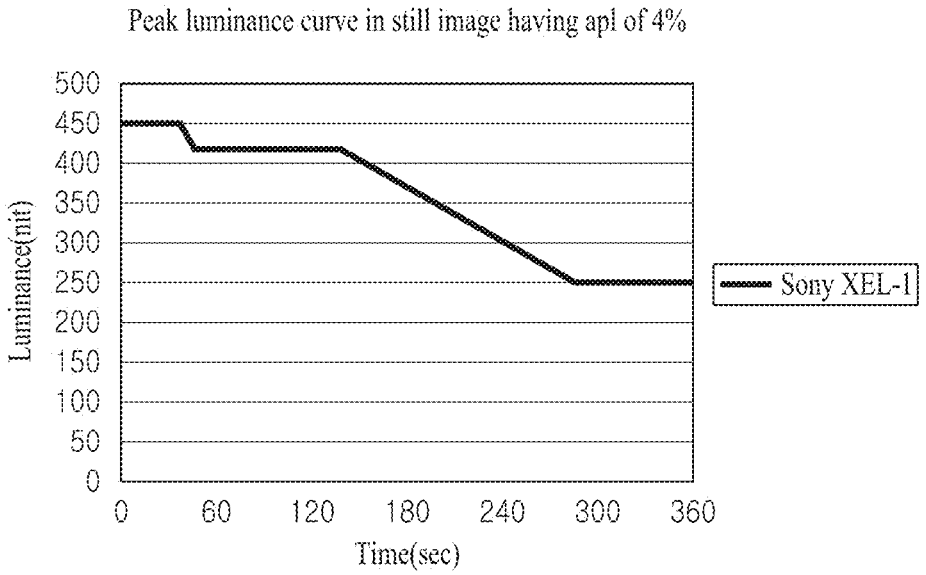
FIG. 1 [ Related Art ]
FIG. 1 is a graph showing an example of a method in which luminance is reduced with time in a related art organic light emitting display device.
Figure 2:
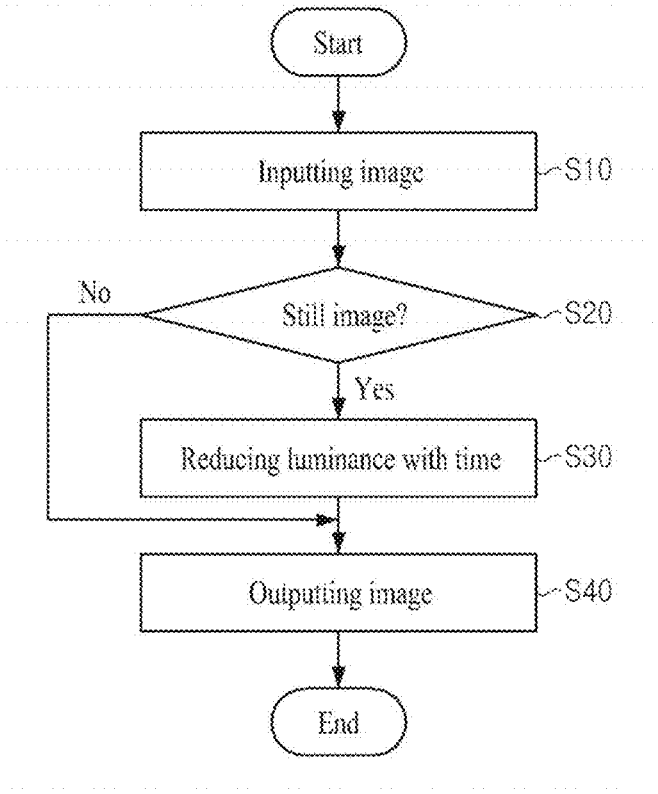
FIG. 2 [ Related Art ]
FIG. 2 is a flowchart illustrating a related art method of reducing luminance with time.
Figure 3:
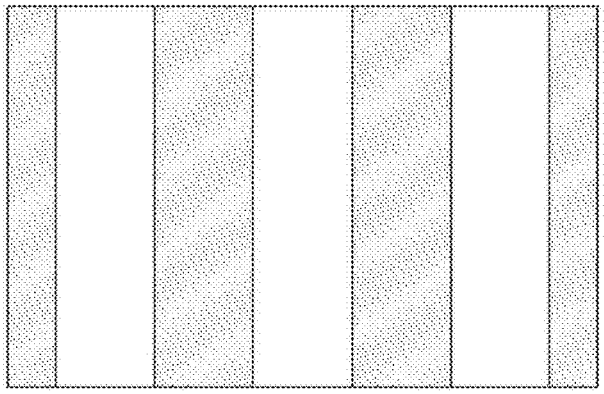
FIG. 3 [ Related Art ]
FIG. 3 is exemplary diagrams illustrating images having the same total average luminance when applying the related art method of reducing luminance with time.
Figure 3:
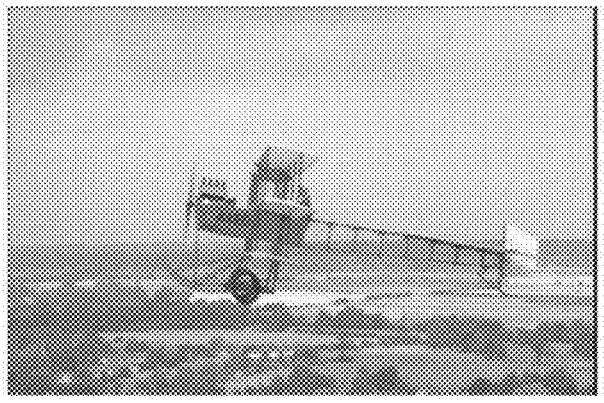
FIG. 3 [ Related Art ]
Figure 4:
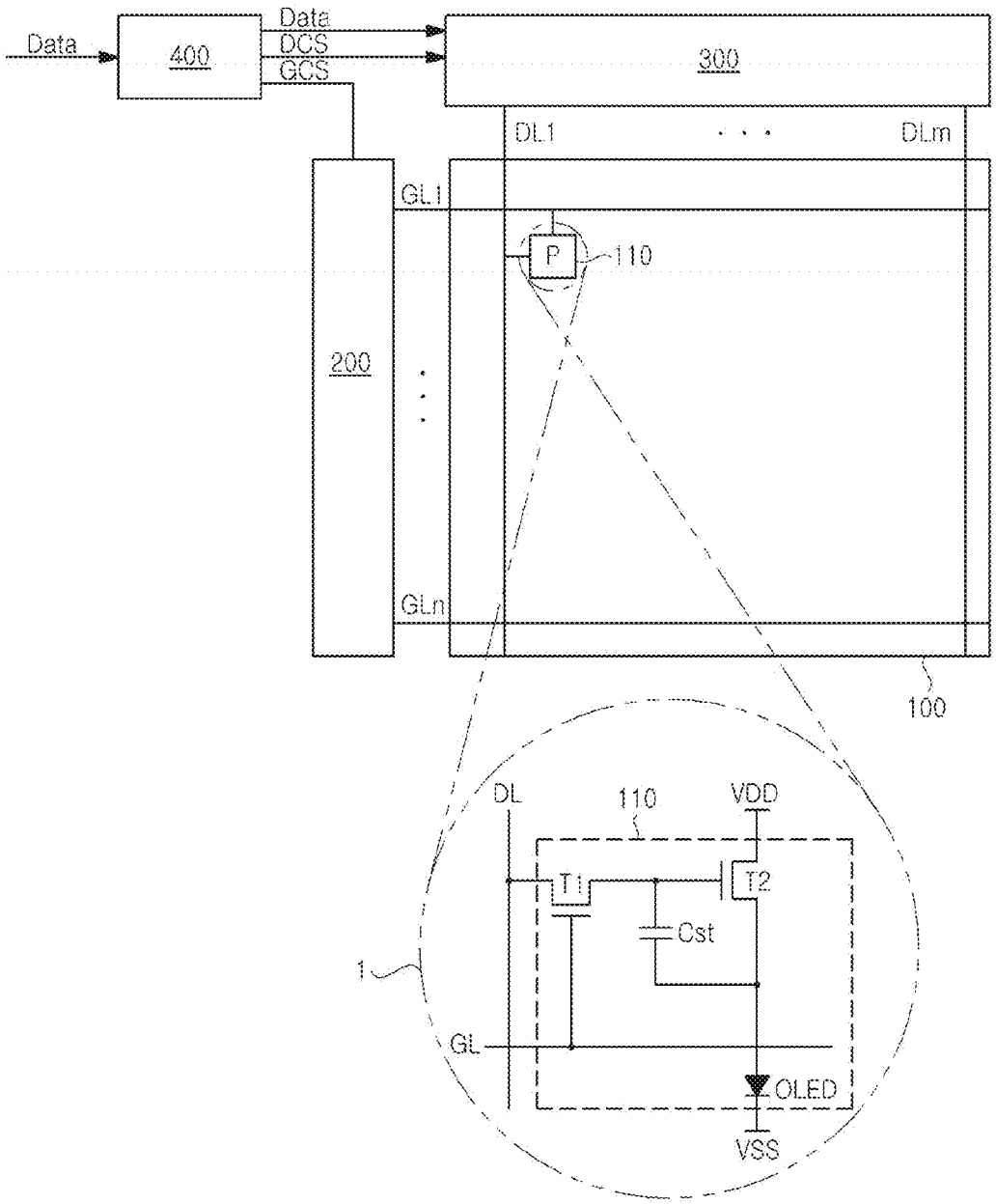
FIG. 4 is an exemplary diagram illustrating a configuration of a display device using a timing controller according to the present invention.

FIG. 4 is an exemplary diagram illustrating a configuration of a display device using a timing controller according to the present invention.

Organic light emitting display devices include a separate driving current element, and may adjust a consumption current according to an average luminance of an image.

The present invention temporally reduces a driving current of an organic light emitting display device in consideration of a scene change point, and may be applied to various types of display devices that adjust a consumption current with a driving current, in addition to organic light emitting display devices. Hereinafter, for convenience of description, an organic light emitting display device will be described as an example of the present invention.

The present invention detects a scene change point of a moving image, and in the same scene section, the present invention gradually reduces luminance of input video data to the maximum reduction amount such that a degradation in image quality is not discerned.

To this end, by using a scene change algorithm such as histogram matching between a previous frame and a current frame, the present invention gradually reduces luminance of image data to the maximum reduction amount until a scene change point is detected and then a scene is changed to another scene.

The display device according to the present invention, as illustrated in FIG. 4, may include a panel 100, a gate driver 200 that is configured with at least one or more gate driving integrated circuit (IC) for driving a plurality of gate lines of the panel 100, a data driver 300 that is configured with at least one or more source driving IC for driving a plurality of data lines of the panel 100, and a timing controller 400 for controlling the gate driving IC and the source driving IC.

The panel 100 includes a plurality of sub-pixels 110 that are respectively formed in a plurality of areas defined by intersections between the plurality of gate lines and the plurality of data lines.

The sub-pixels 110 may be configured a white (W) sub-pixel, a red (R) sub-pixel, a green (G) sub-pixel, and a blue (B) sub-pixel. An arrangement type of the sub-pixels may be variously changed. The sub-pixels 110 may output light of a unique color, or output white light. In the latter, the panel 100 may include a plurality of color filters that respectively realize a white color, a red color, a green color, and a blue color.

Each of the sub-pixels 110, as illustrated in an enlarged circular block 1 of FIG. 4, may include an organic light emitting diode OLED and at least two or more transistors T1 and T2 that are connected to a data line DL and a gate line GL to control the organic light emitting diode (OLED).

An anode of the organic light emitting diode OLED is connected to a first power source VDD, and a cathode of the organic light emitting diode OLED is connected to a second power source VSS. The organic light emitting diode OLED emits light of certain luminance in response to a current supplied from a second transistor T2.

A circuit provided in each sub-pixel 110 controls an amount of current supplied to the organic light emitting diode OLED in response to an image signal supplied to the data line DL when a scan signal is supplied to the gate line GL. To this end, each sub-pixel 110 includes the second transistor (a driving transistor) T2 connected between the first power source VDD and the organic light emitting diode OLED, a first transistor (a switching transistor) T1 connected to the second transistor T2, the data line DL, and the gate line GL, and a storage capacitor Cst connected between a gate of the second transistor T2 and the organic light emitting diode OLED.

The timing controller 400 generates a gate control signal GCS used to control an operation timing of the gate driving ICs and a data control signal DCS used to control an operation timing of the data driving ICs, by using a timing signal (i.e., a vertical sync signal Vsync, a horizontal sync signal Hsync, and a data enable signal DE) input from an external system. The timing controller 400 receives input video data from the external system to generate image data which are transferred to the source driving ICs of the data driver 300.

The timing controller 400 determines whether a scene is changed, continuously reduces luminance of the input video data to the maximum reduction amount during the same scene section until the scene is changed and then changed to another scene, and transfers image data with reduced luminance to the data driver 300.

That is, the timing controller 400 reduces luminance of image data included in the same scene section, realigns the input video data according to a characteristic of the panel 100, and outputs the realigned image data with reduced luminance.

A detailed configuration and function of the timing controller 400 according to the present invention, which performs the above-described function, will be described in detail with reference to FIGS. 4 to 10.

Each of the gate driving ICs configuring the gate driver 200 supplies the scan signal to a plurality of corresponding gate lines by using a plurality of the gate control signals GCS generated by the timing controller 400.

The gate driving IC applied to the present invention may use the gate driving IC of related art flat panel display devices as-is. The gate driving IC applied to the present invention may be provided independently from the panel 100, and may be configured as a type capable of being electrically connected to the panel 100. For example, the gate driving IC applied to the present invention may be configured as a gate-in panel (GIP) type in which the gate driving IC is built into the panel 100.

Finally, the source driving IC configuring the data driver 300 converts image data, transferred from the timing controller 400, into analog image signals and respectively supplies the image signals for one horizontal line to a plurality of corresponding data lines at every one horizontal period in which the scan signal is supplied to one gate line.

The source driving IC converts the image data into the image signals by using gamma voltages supplied from a gamma voltage generator (not shown), and respectively outputs the image signals to a plurality of corresponding data lines. To this end, the source diving IC includes a shift register, a latch, a digital-to-analog converter (DAC), and an output buffer.

Figure 5:
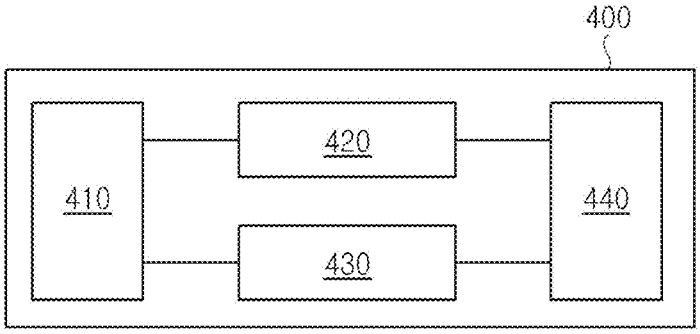
FIG. 5 is an exemplary diagram illustrating an internal configuration of the timing controller according to the present invention.

FIG. 5 is an exemplary diagram illustrating an internal configuration of the timing controller 400 according to the present invention.

The timing controller 400 according to the present invention, as illustrated in FIG. 5, includes: a receiver 410 that receives the timing signal and the input video data from the external system; a data aligner 430 that continuously reduces luminance of the input video data to the maximum reduction amount in the same scene section until a scene is changed and then changed to another scene; a control signal generator 420 that generates the gate control signal GCS and the data control signal DCS by using the timing signal transferred from the receiver 410; and a transferor 440 that transfers the image data from the data aligner 430 and the data control signal from the control signal generator 420 to the data driver 300, and transfers the gate control signal, output from the control signal generator 420, to the gate driver 200.

The receiver 410 receives the input video data and the timing signal from the external system, and transfers the input video data to the data aligner 420. The timing signal received through the receiver 410 may be transferred directly from the receiver 410 to the control signal generator 420, or may be transferred to the control signal generator 420 via the data aligner 420.

The control signal generator 420 generates the gate control signal used to control a timing of the gate driver 200 and the data control signal used to control a timing of the data driver 300, by using a plurality of the timing signals received from the receiver 410.

Finally, the data aligner 430 sequentially stores input video data of respective frames, and compares the input video data of the respective frames to determine whether a scene is changed. When it is determined that the scene is changed, in the same scene section until the scene is changed and then changed to another scene, the data aligner 430 reduces luminance of the input video data included in the scene section, and outputs image data with reduced luminance. A detailed configuration and function of the data aligner 430 will be described in detail with reference to FIGS. 6 to 9.

Figure 6:
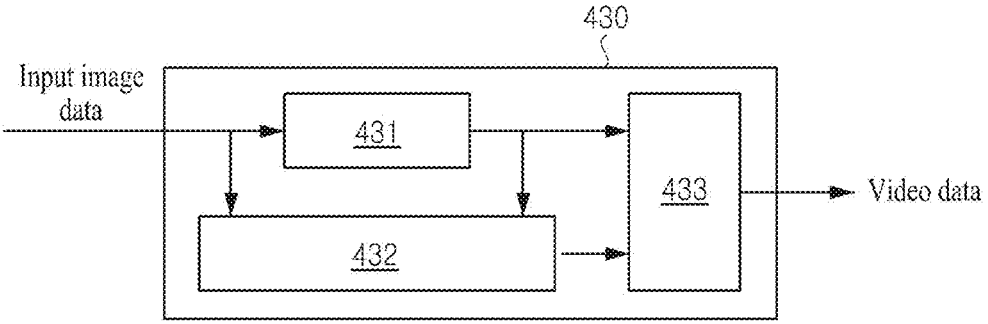
FIG. 6 is an exemplary diagram illustrating a detailed configuration of a data aligner of the timing controller according to the present invention.
Figure 7:
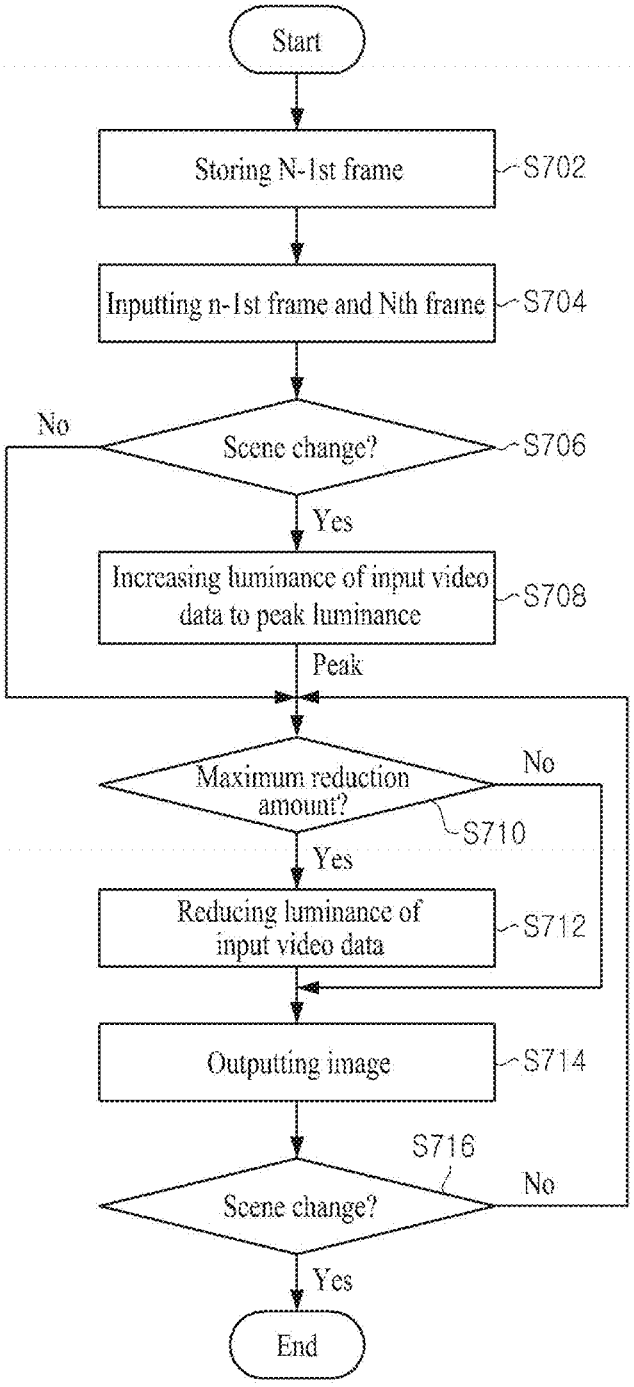
FIG. 7 is a flowchart illustrating an embodiment of a method of driving the timing controller according to the present invention.
Figure 8:
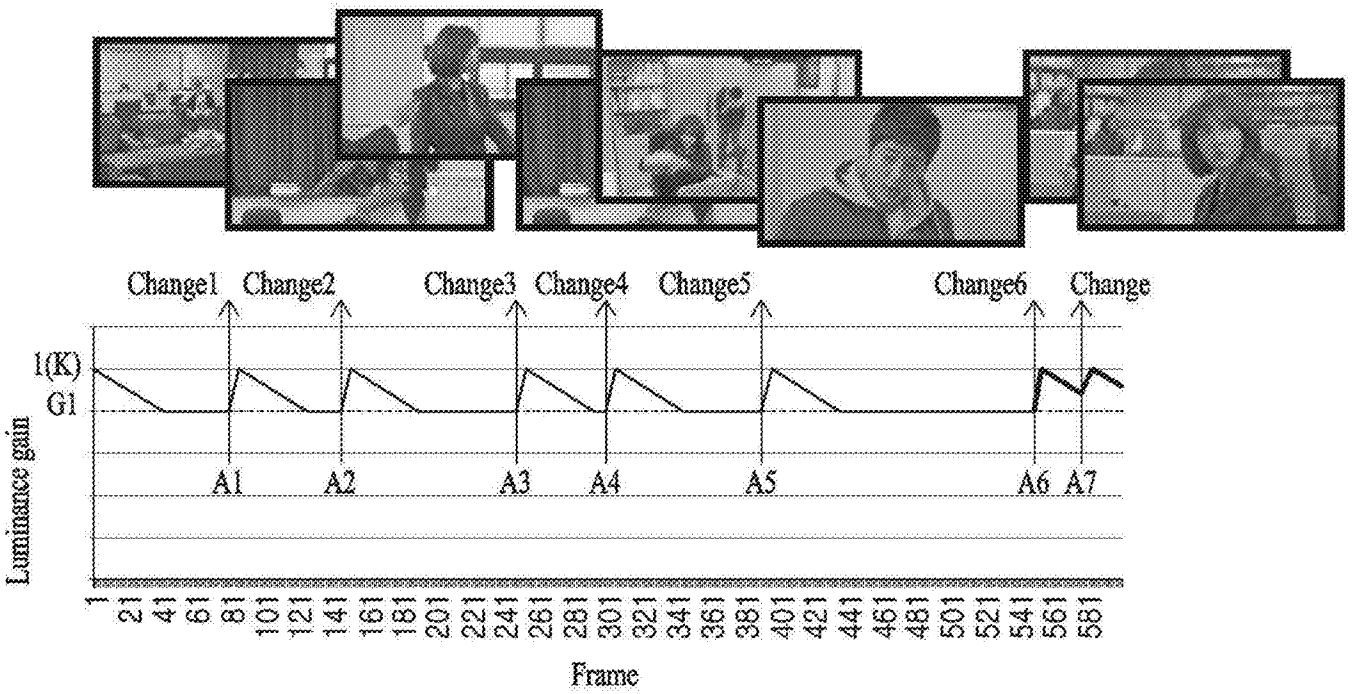
FIG. 8 is a graph showing a state in which luminance is being reduced in the same scene section by the timing controller driving method according to the present invention.
Figure 9:
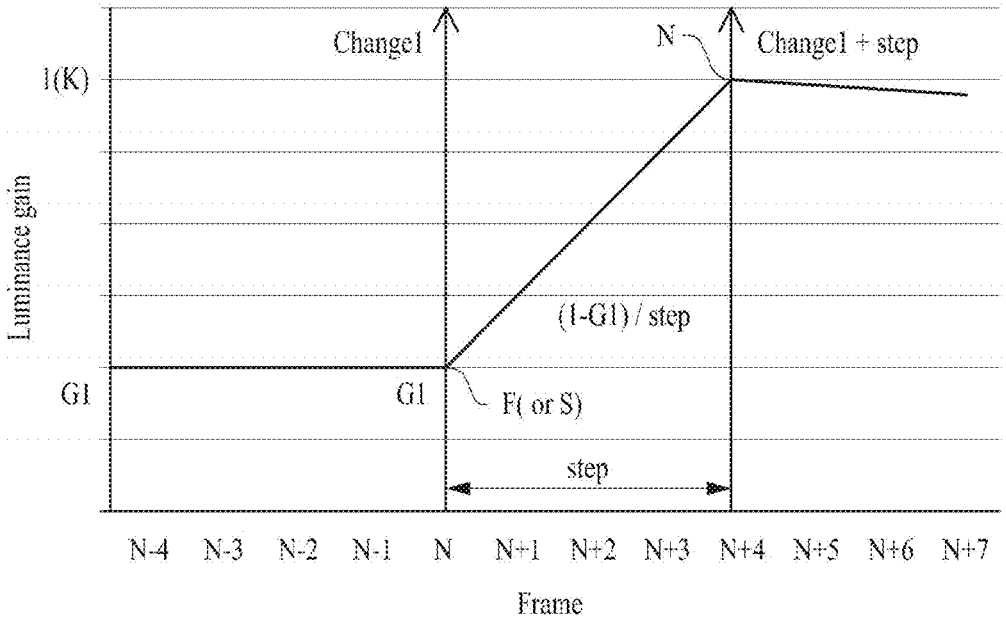
FIG. 9 is a graph showing a state in which luminance is increasing to peak luminance at a scene change point by the timing controller driving method according to the present invention.

FIG. 6 is an exemplary diagram illustrating a detailed configuration of the data aligner 430 of the timing controller 400 according to the present invention, and illustrates an internal configuration of the data aligner 430 of FIG. 5. FIG. 7 is a flowchart illustrating an embodiment of a method of driving the timing controller 400 according to the present invention, FIG. 8 is a graph showing a state in which luminance is being reduced in the same scene section by the timing controller driving method according to the present invention, and FIG. 9 is a graph showing a state in which luminance is increasing to peak luminance at a scene change point by the timing controller driving method according to the present invention.

The data aligner 430, as illustrated in FIG. 6, includes: a memory 431 that sequentially stores input video data of respective frames; a determiner 432 that compares the input video data of the respective frames to determine whether a scene is changed; and a converter 433 that, when it is determined that the scene is changed, in the same scene section until the scene is changed and then changed to another scene, reduces luminance of the input video data included in the scene section, and outputs image data with reduced luminance.

First, the memory 431 stores the input video data of respective frames. That is, the memory 431 stores input video data included in an N-1st frame in operation S702.

Here, the input video data may be video data that are input from the external system, or may be video data that have been primarily converted by the timing controller 400.

The determiner 432 compares the input video data of the respective frames to determine whether a scene is changed in operations S704 and S706.

That is, the determiner 432 receives input video data of a previous frame (the N-1st frame) stored in the memory 431 and input video data of a current frame (a Nth frame) in operation S704, and compares the received input video data to determine whether a scene is changed between the two frames in operation S706.

Here, the scene change denotes that images recognizable as different scenes are output. As a simple example, when a camera captures an image without being powered off, it may be considered that a scene is not changed between frames composing the captured images. That is, when the camera is again powered on after power-off and captures another image, it may be considered that a scene is changed between a frame previous to the power-off of the camera and a frame subsequent to the power-on of the camera.

However, even though the camera is powered off and then is again powered on, a scene may not be changed when a time interval is not great, there is no motion of the camera, and an object to be captured is not greatly changed.

That is, the camera being again powered on after power-off denotes that an object to be captured is changed before and after the camera is powered on.

As another example, even when an object to be captured is greatly changed, a scene may be changed.

That is, in the present invention, the scene change denotes a state in which images recognizable as different images are output.

Examples of the method of detecting a scene change may include various methods such as a whole pixel comparison method, a histogram matching method, etc.

The whole pixel comparison method calculates a difference value between all pixels of a previous frame and all pixels of a current frame, and determines a case, in which the difference value is greater than an arbitrary threshold value, as a scene change point.

The histogram matching method calculates a difference value between a histogram of a previous frame and a histogram of a current frame, and determines a case, in which the difference value is greater than an arbitrary threshold value, as a scene change point.

In addition to the above-described methods, the determiner 432 may determine a scene change point by using various methods.

Subsequently, when it is determined that a scene is changed, the converter 433 reduces luminance of the input video data to the maximum reduction amount based on a predetermined luminance reduction rate in the same scene section until a scene is changed and then changed to another scene, and then maintains the luminance at the maximum reduction amount until the changed scene is changed to the other scene in operations S708 to S716. In a first process, when it is determined that there is the scene change in operation S706, the converter 433 increases luminance of the input video data of the current frame (the Nth frame) from an amount of luminance, applied to the frame (the N-1st frame) before the scene change, to peak luminance in operation S708.

That is, when the scene change is performed, the converter 433 may gradually reduce the luminance of the input video data from the original luminance (hereinafter simply referred to as peak luminance) according to the luminance reduction rate in operation S712.

However, a frame immediately previous to the scene change is also in a state in which the luminance of the input video data has been reduced in operations S710 to S714, the scene change is performed, and then, when the peak luminance of the input video data is output as-is, the luminance can suddenly increase.

Therefore, when the scene change is performed, the present invention can restore the luminance of the input video data from a start luminance amount, which is lower than the peak luminance of the input video data, to the peak luminance.

Here, the start luminance amount may be set to the same luminance amount as an end luminance amount applied to input video data immediately previous to the scene change.

For example, when there are a plurality of scene changes as shown in FIG. 8, a change state of luminance at a scene change1 point A1 is shown in FIG. 9.

That is, since the present invention reduces luminance of input video data of the N-1 st frame even immediately before the scene change1 point A1, the luminance of the input video data of the N-1st frame is lower than the peak luminance, and the luminance is referred to as an end luminance amount F.

Moreover, after the scene change1 point A1, luminance of input video data of the Nth frame increases from the end luminance amount F to become the peak luminance of the input video data. Therefore, in the input video data of the Nth frame, the end luminance amount F may become a start luminance amount S.

In this case, a period in which the luminance is restored from the start luminance amount S to the peak luminance K may be decided as the number of frames.

To provide an additional description, luminance is gradually reduced in the same scene section, and then when the luminance reaches a scene change point, the luminance is again restored. Therefore, a scene change point A becomes a luminance restoration point in terms of the Nth frame, and information (a step) about during how many frames luminance is restored to the peak luminance may be previously set. As the step becomes broader, the luminance is gradually and naturally restored.

A gain defined based on the details is applied as expressed in Equation (1). An image "$Y_{new}$" is output with Equation (1).

$$Y_{new}(i,j)=\text{gain}\times Y(i,j) \tag{1}$$

where i denotes a horizontal direction index of the image, and j denotes a vertical direction index.

Finally, the luminance of the input video data of the Nth frame is restored from the start luminance amount S to the peak luminance, and then, as shown in FIG. 8, the converter 433 reduces the luminance of the input video data sequentially from the peak luminance, and output image data with reduced luminance in operations S710, S712, and S714.

That is, when a scene change is performed, the present invention sequentially reduces luminance of input video data included in the same scene section according to a luminance reduction rate.

In the same scene sections, the luminance reduction rate may be identically applied, or may be differently set in consideration of total luminance of a moving image.

The luminance reduction rate denotes a rate of reduced luminance, and denotes during how many frames and by how much luminance is reduced. That is, the luminance reduction rate may be a slope of a luminance change curve in the graph of FIG. 8.

Moreover, the converter 433 reduces the luminance of the input video data to the maximum reduction amount based on the predetermined luminance reduction rate in the same scene section, and then maintains the luminance at the maximum reduction amount until the changed scene is changed to the other scene.

Here, the maximum reduction amount denotes the lowest luminance that is a reducible limit based on the luminance reduction rate.

For example, the maximum reduction amount G1 may be set to a value lower by 1%, 5%, or 10% than the peak luminance that is unique luminance of input video data. That is, the maximum reduction rate G1 defines by what percentage of the peak luminance the luminance of the input video data is reducible.

Therefore, as shown in FIG. 8, when the peak luminance K is 1, the maximum reduction amount G1 may be a rate of the peak luminance K.

In the present invention, luminance of input video data included in the same scene sections may be reduced by using the same luminance reduction rate in the same scene sections.

For example, when the maximum reduction amount G1 is set such that luminance of input video data is reduced from peak luminance of the input video data to only a maximum of 5%, the converter 433 may reduce the luminance of the input video data to the maximum reduction amount G1 in all scene sections.

However, in the same scene sections, the maximum reduction amount G1 may be differently set in consideration of total luminance of a moving image.

As described above, the converter 433 may reduce the luminance of the input video data to the maximum reduction amount G1 based on the predetermined luminance reduction rate in the same scene section, and then maintains the luminance at the maximum reduction amount G1 until the changed scene is changed to the other scene.

That is, when the luminance of the input video data is reduced from the peak luminance K according to the luminance reduction rate, the luminance of the input video data can be reduced lower than the maximum reduction amount G1. However, when the luminance becomes far lower than the peak luminance, a quality of an image can be degraded, and a user can feel a reduction in luminance with eyes.

Therefore, the present invention prevents luminance of input video data from being reduced lower than the maximum reduction amount G1.

The maximum reduction amount G1 may be variously set in consideration of a luminance discernment ability of a user, a quality of an image, and an efficiency of a consumption current.

The final process will be briefly described as follows.

In operation S710, the converter 433 determines whether a scene change is performed, luminance of input video data increases to the peak luminance K, and the luminance of the input video data is reduced to the maximum reduction amount G1.

When it is determined that the luminance of the input video data is greater than the maximum reduction amount G1, the converter 433 reduces the luminance of the input video data in operation S712, and outputs an image with reduced luminance in operation S714.

When it is determined that the luminance of the input video data is equal to the maximum reduction amount G1, the converter 433 outputs an image with reduced luminance without reducing the luminance of the input video data in operation S714.

The above-described operations S710 to S714 are repeated, and then, when another scene change is performed, operation S708 of increasing the luminance of the input video data to the peak luminance is repeated.

Figure 10:
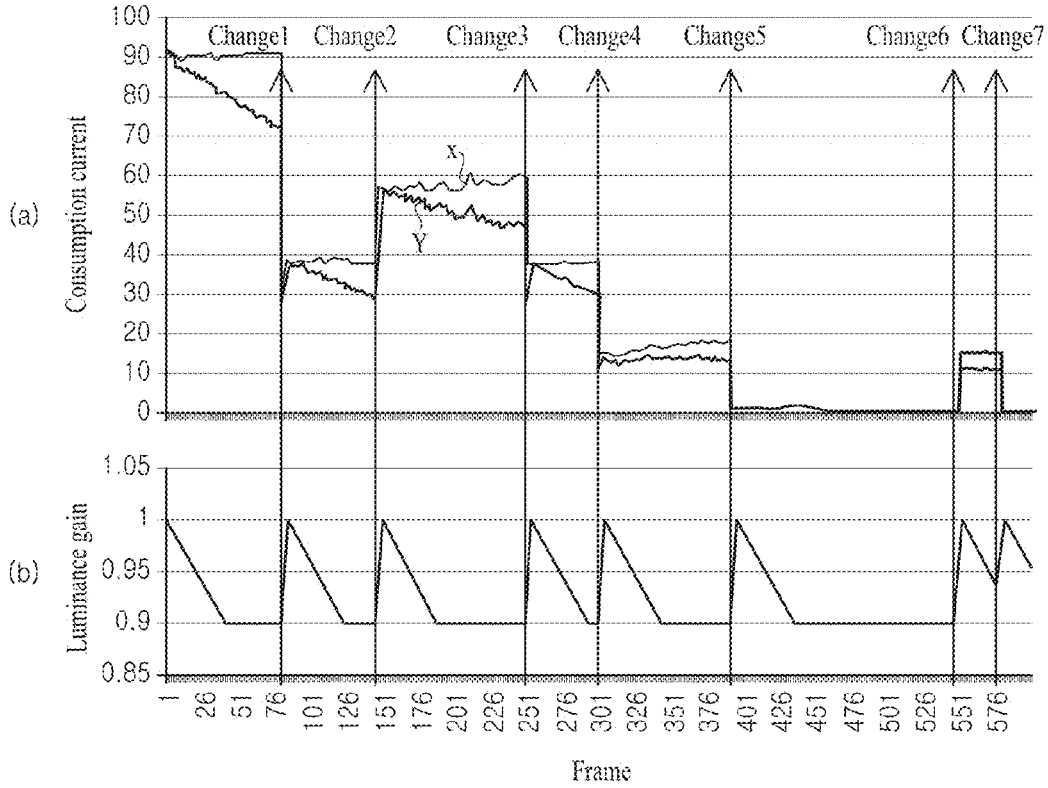
FIG. 10 is an exemplary diagram showing a result that is obtained by temporally decreasing a consumption current in consideration of a plurality of scene change points during 600 frames in the display device according to the present invention.

FIG. 10 is an exemplary diagram showing a result that is obtained by temporally decreasing a consumption current in consideration of a plurality of scene change points during 600 frames in the display device according to the present invention. A portion (a) of FIG. 10 shows a change in consumption current with respect to a time axis, and a portion (b) of FIG. 10 shows a change in luminance with respect to the time axis. Also, in the portion (a) of FIG. 10, x indicates a consumption current when the present invention is not applied, and y indicates a consumption current when the present invention is applied. Also, for convenience of description, the portion (b) of FIG. 10 shows the graph of FIG. 8 as-is.

Referring to FIG. 10, when the consumption current before the present invention is applied is 33.04 A, the consumption current after the present invention is applied is 28.88 A, and thus, it can be seen that the consumption current is reduced by about 12.6%. Such a result is obtained when, in the graph of the portion (b) of FIG. 10, the maximum reduction amount G1 is 0.9, and a step that is a luminance restoration period is set to four frames.

The consumption current is calculated as expressed in the following Equation (2).

$$\text{current}(I) = \frac{\text{luminance} \times \text{pixel area}}{Pol.\ \text{transmittance} \times \text{element efficiency}} \tag{2}$$

where the pixel area, the Pol. transmittance, and the element efficiency may be variously set depending on a model specification.

As described above, the present invention continuously reduces luminance of input video data to the maximum reduction amount in the same scene section until a scene is changed and then changed to another scene, thus efficiently and naturally decreasing a consumption current.

Moreover, the present invention adjusts a change amount (a reduction amount and increase amount) of luminance to a desired change amount, thus minimizing a degradation in image quality.

Moreover, the present invention provides technology for temporally reducing power consumption, and can efficiently reduce power consumption in combination with another technology for spatially reducing a consumption current.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A timing controller of an organic light emitting diode (OLED) display device comprising:

a memory configured to sequentially store input video data of respective frames, wherein the input video data is of a moving image;

a determiner configured to compare the input video data of respective frames to determine whether a scene in the input video data is changed; and a converter configured to:

reduce luminance of the input video data comprised in a first scene section that includes a first scene responsive to the determiner determining that the scene is changed to the first scene, the luminance of the input video data reduced from a peak luminance to a luminance that is lower than the peak luminance;

output image data comprised in the first scene section including the first scene with the reduced luminance, wherein driving currents supplied to organic light emitting diodes included in the OLED display device are reduced in accordance with the reduced luminance of the outputted image data;

gradually increase the luminance of the input video data from the lower luminance to the peak luminance responsive to the determiner determining that the first scene is changed to a second scene included in a second scene section;

output image data comprised in the second scene section including the second scene with the increased luminance, wherein the driving currents supplied to the organic light emitting diodes are gradually increased in accordance with the gradual increase of the luminance of the outputted image data, reduce the luminance of the input video data from the peak luminance to the luminance that is lower than the peak luminance while a plurality of frames corresponding to the second scene are displayed immediately after the gradual increase of the luminance reaches the peak luminance; and output image data comprised in the second scene section including the second scene with the reduced luminance, wherein the driving currents supplied to the organic light emitting diodes are decreased in accordance with the reduction of the luminance of the outputted image data;

wherein the converter reduces the luminance of the input video data in the first scene section to a maximum reduction amount based on a predetermined luminance reduction rate, and wherein the maximum reduction amount is differently set according to a peak luminance of total input video data in each same scene section.

2. The timing controller of claim 1, wherein the converter reduces the luminance of the input video data comprised in the first scene section using a same luminance reduction rate in the first scene section.

3. The timing controller of claim 1, wherein the converter maintains the reduced luminance at the maximum reduction amount until the first scene is changed to the second scene.

4. The timing controller of claim 1, wherein the converter is further configured to reduce the luminance of the input video data comprised in the second scene section.

5. The timing controller of claim 4, wherein the converter reduces the luminance of the input video data comprised in the second scene section from the peak luminance to the lower luminance.

6. The timing controller of claim 1, wherein a period in which the luminance is gradually increased from the lower luminance amount to the peak luminance is decided as number of frames.

7. The timing controller of claim 1, wherein the determiner calculates a difference value between all pixels of a previous frame and all pixels of a current frame and determines that the scene in the input video data is changed when the difference value is greater than a predetermined threshold value.

8. The timing controller of claim 1, wherein a determiner calculates a difference value between a histogram of a previous frame and a histogram of a current frame and determines that the scene in the input video data is changed when the difference value is greater than a predetermined threshold value.

9. A method of driving a timing controller of an organic light emitting diode (OLED) display device, the method comprising:

sequentially storing input video data of respective frames, wherein the input video data is of a moving image;

comparing the input video data of respective frames to determine whether a scene in the input video data is changed;

reducing luminance of the input video data comprised in a first scene section that includes a first scene responsive to determining that the scene is changed to the first scene, the luminance of the input video data reduced from a peak luminance to a luminance that is lower than the peak luminance;

outputting image data comprised in the first scene section including the first scene with the reduced luminance by reducing driving currents supplied to organic light emitting diodes included in the OLED display device in accordance with the reduced luminance of the outputted image data;

gradually increasing the luminance of the input video data from the lower luminance to the peak luminance responsive to determining that the first scene is changed to a second scene included in a second scene section;

outputting image data comprised in the second scene section including the second scene with the increased luminance by gradually increasing the driving currents supplied to the organic light emitting diodes in accordance with the gradual increase of the luminance of the outputted image data, reducing the luminance of the input video data from the peak luminance to the luminance that is lower than the peak luminance while a plurality of frames corresponding to the second scene are displayed immediately after the gradual increase of the luminance reaches the peak luminance; and outputting image data comprised in the second scene section including the second scene with the reduced luminance by decreasing the driving currents supplied to the organic light emitting diodes in accordance with the reduction of the luminance of the outputted image data, wherein the luminance of the input video data in the first scene section is reduced to a maximum reduction amount based on a predetermined luminance reduction, and wherein the maximum reduction amount is differently set according to a peak luminance of total input video data in each same scene section.

10. The method of claim 9, wherein the reduced luminance is maintained at the maximum reduction amount until the first scene is changed to the second scene.

11. The method of claim 9, further comprising: reducing the luminance of the input video data comprised in the second scene section from the peak luminance to the lower luminance.

12. The method of claim 9, wherein the luminance of the input video data comprised in the first scene section is reduced using a same luminance reduction rate in the first scene section.

13. The method of claim 9, wherein a period in which the luminance is gradually increased from the lower luminance amount to the peak luminance is decided as number of frames.

14. An organic light emitting diode (OLED) display device comprising:

a panel configured to include a plurality of pixels comprising a plurality of organic light emitting diodes, the plurality of pixels respectively formed in a plurality of areas defined by intersections between a plurality of gate lines and a plurality of data lines;

a timing controller including:

a memory configured to sequentially store input video data of respective frames, wherein the input video data is of a moving image;

a determiner configured to compare the input video data of respective frames to determine whether a scene in the input video data is changed; and a converter configured to:

reduce luminance of the input video data comprised in a first scene section that includes a first scene responsive to the determiner determining that the scene is changed to the first scene, the luminance of the input video data reduced from a peak luminance to a luminance that is lower than the peak luminance;

output image data comprised in the first scene section including the first scene with the reduced luminance, wherein driving currents supplied to the plurality of organic light emitting diodes are reduced in accordance with the reduced luminance of the outputted image data;

gradually increase the luminance of the input video data from the lower luminance to the peak luminance responsive to the determiner determining that the first scene is changed to a second scene included in a second scene section;

output image data comprised in the second scene section including the second scene with the increased luminance, wherein the driving currents supplied to the plurality of organic light emitting diodes are gradually increased in accordance with the gradual increase of the luminance of the outputted image data;

reduce the luminance of the input video data from the peak luminance to the luminance that is lower than the peak luminance while a plurality of frames the second scene are displayed immediately after the gradual increase of the luminance reaches the peak luminance; and output image data comprised in the second scene section including the second scene with the reduced luminance, wherein the driving currents supplied to the organic light emitting diodes are decreased in accordance with the reduction of the luminance of the outputted image data, a data driver configured to convert the outputted image data comprised in the first scene section and the second scene section, transferred from the timing controller, into analog image signals and respectively output the analog image signals to the plurality of data lines; and a gate driver configured to output a scan signal to the plurality of gate lines at every one horizontal period in which the image signals are output, according to a control signal transferred from the timing controller, wherein the converter reduces the luminance of the input video data in the first scene section to a maximum reduction amount based on a predetermined luminance reduction rate, and wherein the maximum reduction amount is differently set according to a peak luminance of total input video data in each same scene section.

15. The display device of claim 14, wherein the converter reduces the luminance of the input video data comprised in the first scene section using a same luminance reduction rate in the first scene section.

16. The display device of claim 14, wherein the converter maintains the reduced luminance at the maximum reduction amount until the first scene is changed to the second scene.

17. The display device of claim 14, wherein the converter is further configured to reduce the luminance of the input video data comprised in the second scene section.

18. The display device of claim 17, wherein the converter reduces the luminance of the input video data comprised in the second scene section from the peak luminance to the lower luminance.

19. The display device of claim 14, wherein a period in which the luminance is gradually increased from the lower luminance amount to the peak luminance is decided as number of frames.

20. The timing controller of claim 14, wherein a determiner calculates a first difference value between all pixels of a previous frame and all pixels of a current frame or a second difference value between a histogram of a previous frame and a histogram of a current frame and determines that the scene in the input video data is changed when the first difference value or the second difference value is greater than a predetermined threshold value.

* * * * *